US005807616A

United States Patent [19]

Trotter, Jr.

[11] Patent Number: 5,807,616

[45] Date of Patent: Sep. 15, 1998

[54] THERMAL CRACKING PROCESS AND FURNACE ELEMENTS

[75] Inventor: Donald M. Trotter, Jr., Newfield, N.Y.

[73] Assignee: Corning Incorporated, Corning, N.Y.

[21] Appl. No.: 427,338

[22] Filed: Apr. 24, 1995

[51] Int. Cl.[6] ..... B32B 15/04

[52] U.S. Cl. ..... 428/34.4; 428/34.6; 428/446; 428/450; 428/471; 428/472; 428/701; 428/702

[58] Field of Search ..... 138/143, 147; 428/34.4, 34.6, 334, 471, 472, 633, 469, 446, 450, 701, 702

[56] References Cited

U.S. PATENT DOCUMENTS

| | | | |
|---|---|---|---|
| 3,368,712 | 2/1968 | Sanford et al. | 220/64 |
| 3,397,076 | 8/1968 | Little et al. | 117/70 |
| 3,597,241 | 8/1971 | Perugini | 106/1 |
| 3,719,519 | 3/1973 | Perugini | 117/71 M |
| 4,099,990 | 7/1978 | Brown et al. | 148/6.35 |
| 4,410,418 | 10/1983 | Kukes et al. | 208/48 R |
| 4,724,064 | 2/1988 | Reid | 208/48 R |
| 5,208,069 | 5/1993 | Clark et al. | 427/226 |
| 5,242,574 | 9/1993 | Broutin et al. | 208/48 R |
| 5,250,360 | 10/1993 | Andrus et al. | 428/471 |
| 5,269,137 | 12/1993 | Edwards, III | 60/261 |
| 5,298,332 | 3/1994 | Andrus et al. | 428/469 |

FOREIGN PATENT DOCUMENTS

| | | |
|---|---|---|
| 0 608 081 A1 | 7/1994 | European Pat. Off. . |
| 1199483 | 7/1970 | United Kingdom . |
| 1604604 | 12/1981 | United Kingdom . |

*Primary Examiner*—Timothy M. Speer
*Attorney, Agent, or Firm*—Milton M. Peterson

[57] ABSTRACT

A method of lessening the tendency for carbon to deposit on a metal surface during thermal cracking of hydrocarbons which comprises isolating the metal surface with a glass-ceramic coating, and a coated furnace element for use in such method.

9 Claims, 2 Drawing Sheets

THERMAL CRACKING PROCESS AND FURNACE ELEMENTS

U.S. application Ser. No. 08/427,381 is filed concurrently herewith by T. R. Kozlowski et al. under the title METHOD OF PROTECTING METAL and assigned to the same assignee as the present application. It is directed to protecting a metal from embrittlement due to carburization. The metal is insulated from contact with carbon by a glass-ceramic coating on the exposed metal surface.

FIELD OF THE INVENTION

A method of thermal cracking a stream containing hydrocarbons and elements of a furnace for use in such method.

BACKGROUND OF THE INVENTION

The invention is concerned with improvements in the thermal cracking of hydrocarbons, such as ethane, propane, butane, naphtha, or gas oil to form olefins, such as ethylene, propylene, or butenes. It is particularly concerned with avoiding, or at least lessening, the formation of carbon deposits, commonly referred to as coke, on a reactor element wall during a thermal cracking process.

At the heart of a thermal cracking process is the pyrolysis furnace. This furnace comprises a fire box through which runs a serpentine array of tubing. This array is composed of lengths of tubing and fittings that may total several hundred meters in length. The array of tubing is heated to a carefully monitored temperature by the fire box. A stream of feedstock is forced through the heated tubing under pressure and at a high velocity, and the product quenched as it exits. For olefin production, the feedstock is frequently diluted with steam. The mixture is passed through the tubing array which is commonly operated at a temperature greater than 750° C. During this passage, a carboniferous residue is formed and deposits on the tube walls and fittings.

Initially, carbon residue appears in a fibrous form on the walls. It is thought this results from a catalytic action, primarily due to nickel and iron in the tube metal. The carbon fibers on the tube wall appear to form a mat which traps pyrolitic coke particles formed in the gas stream. This leads to build-up of a dense, coke deposit on the walls of the tubing and fittings.

The problem of carbon deposits forming during the thermal cracking of hydrocarbons is one of long standing. It results in restricted flow of the gaseous stream of reaction material. It also reduces heat transfer through the tube wall to the gaseous stream. The temperature to which the tube is heated must then be raised to maintain a constant temperature in the stream flowing through the tube. This not only reduces process efficiency, but ultimately requires a temperature too high for equipment viability, as well as safety requirements. A shutdown then becomes necessary to remove the carbon formation, a process known as decoking.

Numerous solutions to the problem of coking have been proposed. One such solution involves producing metal alloys having special compositions. Another proposed solution involves coating the interior wall of the tubing with a silicon-containing coating, such as silica, silicon carbide, or silicon nitride. In still another proposal, the interior wall of the tubing is treated with an aluminum compound. This process involves aluminum surface conversion as well as diffusion into the metal. It has also been proposed to introduce additives, such as sulfides, to the feedstock stream.

Despite these numerous proposals, the problem still remains. It is then a basic purpose of the present invention to provide an effective solution to the problem.

SUMMARY OF THE INVENTION

The process aspect of the invention is a method of at least lessening the tendency for carbon to deposit on a metal surface when that surface is exposed, while heated, to a gaseous stream containing hydrocarbons during a thermal cracking process, the method comprising forming a thin, adherent coating of a glass-ceramic material on the metal surface prior to heating that surface and contacting it with the hot gaseous stream, thereby isolating the metal surface from the hot gaseous stream.

The invention further contemplates furnace elements, including a reactor tube and fittings for insertion in a furnace for thermally cracking or reforming hydrocarbons, the furnace elements having a thin, adherent layer of a glass-ceramic material on at least a portion of their exposed surface to inhibit deposition of carbon on that wall during a thermal cracking process.

PRIOR ART

Prior literature of possible interest is listed in an accompanying document.

DESCRIPTION OF THE INVENTION

Figure 1:
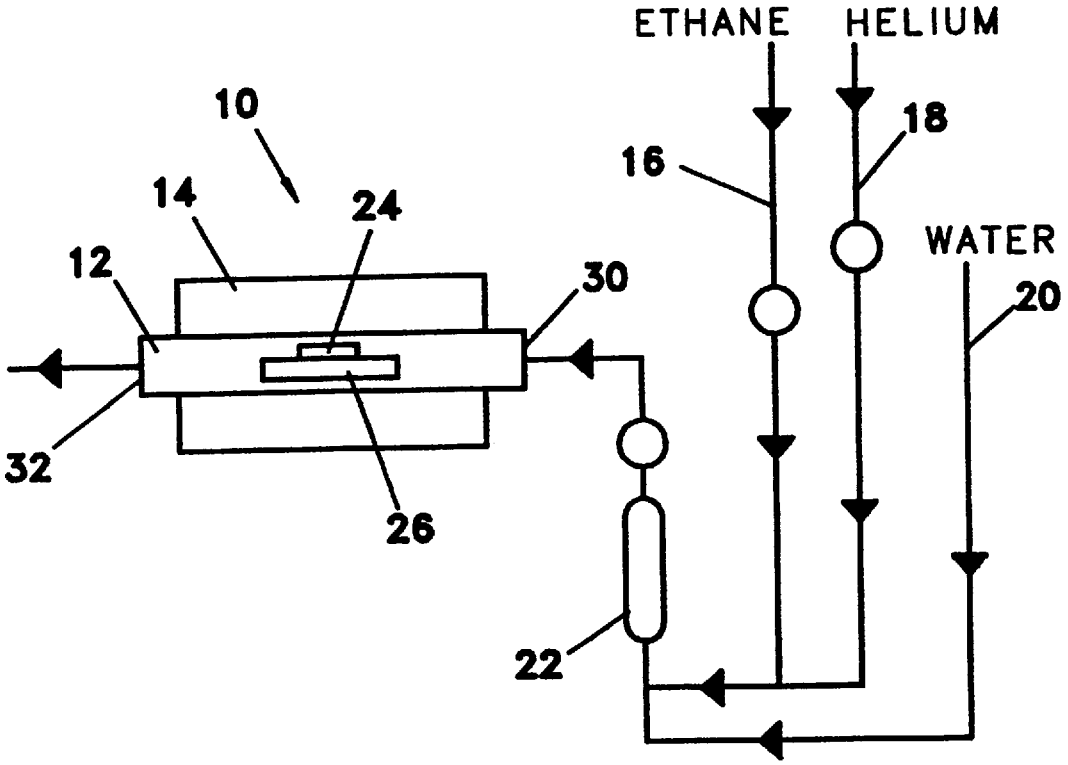
FIG. 1 is a schematic side view of an apparatus suitable for performing tests described herein and FIG. 2 is a front elevation view, partly broken away, showing a segment of a reactor tube in accordance with the invention.

The invention is described with reference to a thermal cracking process for olefin production, and to a reactor tube and fittings for a cracking furnace used in practicing that process. However, the coking problem also occurs in other thermal cracking processes wherein a feed material is fed through a pyrolysis furnace to crack the material into desired components. Accordingly, the invention is also applicable to such other processes as well.

The invention employs a thin coating of a selected glass-ceramic material on an otherwise exposed metal surface. Thereby, carbon deposition on the metal surface is prevented and coking is greatly lessened.

The composition, as well as the physical properties, of the glass-ceramic will depend on the particular application involved. For example, any element known to poison, or otherwise be detrimental to, a particular process should be avoided in a coating composition. Also, the glass-ceramic must not soften, recrystallize, or otherwise undergo detrimental change at the maximum temperature of the process in which it is used.

As initially applied to the metal, the coating may be a flowable material, but is composed essentially of a precursor glass for the glass-ceramic, the glass being in particulate form. The coated metal is then heated to a temperature at which the glass flows and wets the metal surface. During this heating, and prior to complete ceramming, the glass must become sufficiently fluid so that it forms a continuous, essentially non-porous coating. The coated metal is then held at this temperature, or at a somewhat lower temperature depending on the glass, for a time sufficient to permit ceramming, that is uniform crystallization of the glass. The maximum temperature reached in this procedure must be well below that at which the metal undergoes structural modification or other changes.

Another consideration is a reasonable match in coefficient of thermal expansion (CTE) between the glass-ceramic and the metal which it coats. This becomes particularly important where austenitic-type metals are employed, since these metals tend to have high CTEs on the order of $180\times10^{-7}$/° C. In such case, a relatively high silica content is desirable. This provides a cristobalite crystal phase, the inversion of which creates an effective CTE that provides an adequate expansion match.

The presence of alumina in the composition is beneficial to increase glass flow and surface wetting prior to crystallization of the frit. However, it may inhibit cristobalite formation as the frit crystallizes.

Where the feedstock is diluted with another material, the coating must be unaffected by the diluent. For example, hydrocarbon cracking is usually carried out in the presence of steam. In that case, the coating must not interact with the steam, either physically or chemically.

In summary, a glass-ceramic suited to present purposes should exhibit these characteristic features:

1. Have a composition free from elements detrimental to a thermal cracking process.

2. Capable of withstanding an operating temperature of at least 850 ° C. without undergoing detrimental physical or chemical change.

3. Thermal expansion characteristics compatible with austenitic-type metals.

4. Have processing temperatures below a temperature at which the coated metal undergoes change.

5. Form an adherent, continuous, essentially non-porous coating.

Any glass-ceramic material that meets these several conditions may be employed. The alkaline earth metal borates and borosilicates and alkaline earth metal silicates are particularly suitable. In general, based on properties, alkali metal silicates and aluminosilicates are less suitable due to physical and/or chemical incompatibility, including low coefficient of thermal expansion.

For use in a hydrocarbon thermal cracking process our preferred coating is a barium aluminosilicate or strontium-nickel aluminosilicate glass-ceramic. The barium aluminosilicate will have primary crystal phases of sanbornite and cristobalite, a minor phase of $BaAl_2Si_2O_8$, and will contain 20–65% BaO, 25–65% $SiO_2$ and up to 15% $Al_2O_3$. The strontium-nickel aluminosilicate will contain primary crystal phases of $SrSiO_3$ and $Ni_2SiO_4$, a minor phase of cristobalite and will contain 20–60% SrO, 30–70% $SiO_2$, up to 15% $Al_2O_3$ and up to 25% NiO. Glass-ceramics having compositions 14 and 12, respectively, in TABLE I are presently preferred.

TABLE I sets forth, in weight percent on an oxide basis as calculated from the precursor glass batch, the compositions for several different glass-ceramics having properties that adapt them to use for present purposes. Examples 1–6 illustrate alkaline earth metal alumino borates or borosilicates. Examples 7–14 illustrate alkaline earth metal silicates which may contain minor amounts of alumina or zirconia.

TABLE I

| Ex. | $SiO_2$ | $B_2O_3$ | $Al_2O_3$ | BaO | MgO | CaO | ZnO | $ZrO_2$ | MnO | SrO | NiO | F |
|---|---|---|---|---|---|---|---|---|---|---|---|---|
| 1 | — | 19.1 | 27.9 | 42.0 | 11.0 | — | — | — | — | — | — | — |
| 2 | — | 25.4 | 18.6 | 56.0 | — | — | — | — | — | — | — | 6 |
| 3 | 17.5 | 20.2 | 29.7 | — | — | 32.6 | — | — | — | — | — | — |
| 4 | 9.6 | 22.2 | 32.5 | — | — | 35.8 | — | — | — | — | — | — |
| 5 | 30.6 | 12.7 | 3.8 | 15.9 | 23.5 | — | 13.5 | — | — | — | — | — |
| 6 | — | 27.0 | 19.8 | 29.7 | 7.8 | — | 15.8 | — | — | — | — | — |
| 7 | 32.0 | — | — | 40.9 | — | — | — | 8.2 | 18.9 | — | — | — |
| 8 | 33.9 | — | 2.9 | 43.3 | — | — | — | — | 20.0 | — | — | — |
| 9 | 33.2 | 4.8 | — | 42.4 | — | — | — | — | 19.6 | — | — | — |
| 10 | 65.0 | — | 6.9 | — | — | — | — | — | — | 28.1 | — | — |
| 11 | 47.2 | — | — | — | — | — | — | 12.1 | — | 40.7 | — | — |
| 12 | 54.1 | — | 5.7 | — | — | — | — | — | — | 23.3 | 16.8 | — |
| 13 | 38.3 | — | — | — | — | — | — | 5.9 | 22.7 | 33.1 | — | — |
| 14 | 62.7 | — | 5.3 | 32.0 | — | — | — | — | — | — | — | — |

FIG. 1 is a schematic representation of an apparatus designed for experimental testing and generally designated by the numeral 10. Glass-ceramics were tested either in the form of solid bodies or as coatings. Coatings were applied to metal coupons, e.g. HP-45 alloy, cut from lengths of metal tubing cast for pyrolysis furnace use. The coupons were coated with the precursor glass for the glass-ceramic in frit form. Slurries were prepared from glass frits having the exemplary compositions 10, 12 and 14. The slurries were applied to the metal coupons by either spraying the slurry, or by repeatedly dipping the coupon in the slurry. The coating was then dried. Dry glass powders having the compositions of examples 4 and 7 were applied by electrostatic spraying.

Each dried coating was then fired to convert the glass to a glass-ceramic state. A ceramming schedule appropriate for each glass was employed.

Apparatus 10 comprises a quartz reactor tube 12 positioned in an electrically heated furnace 14. A feedstock stream was provided to reactor tube 12 by mixing ethane from a source 16 with a carrier gas, helium, from a source 18 and water from a source 20. Each source was provided with valves and controllers (not shown). The mixture was passed through a steam generator 22 to generate a gaseous mixture that was discharged into reactor tube 12.

In carrying out a test, a test sample 24 was placed on a quartz holder 26 and inserted in the heated tube 12. Reactor tube 12 was a quartz tube 90 cm in length and 4 cm in diameter. It was positioned in furnace 16, and was provided with a sealed entry 30 and a sealed exit 32.

Furnace 14 was designed to heat samples to temperatures in the range of 600–900° C. With the furnace at temperature and a sample in place, a mixture of ethane and steam, in a 4:1 volume ratio, was introduced into tube 12 at entry 30.

Samples of the gaseous product were withdrawn at regular intervals at exit 32. At the completion of each reaction, the sample was cooled to room temperature, and the amount of carbon formed on the test sample was determined by weight difference.

Tests were carried out at a temperature of 850° C. for progressively increasing periods of testing time. In these tests, the ethane-steam mixture was passed through the furnace in the presence of uncoated HP-45 alloy samples to establish an appropriate period of test time. TABLE II presents the results of these tests with time shown in hours; and the weight gains (coke accumulation) in grams.

TABLE II

| Time (hrs) | 2 | 4 | 7 | 13 |
|---|---|---|---|---|
| Wt. Gain/grams | 0.0346 | 0.0502 | 0.0747 | 0.0843 |

The data indicated that progressively increasing amounts of carbon were deposited with time, but that the rate was slower above 7 hours. Accordingly, comparative material runs were made for a period of 7 hours with the furnace temperature at 850° C.

Comparative tests were made on samples prepared as glass-ceramic coupons and as coatings on 5 cm (2") long coupons of an Fe—Cr—Ni alloy containing 0.45% carbon (HP-45 alloy). The metal pieces were cut from a pyrolysis furnace tube. To guard against pin holes, the coatings had a thickness of at least about 0.0375 mm (1.5 mils). Much thicker coatings may be employed, but no advantage is seen. During each test, carbon deposition was determined by weight difference of the sample.

TABLE III shows, in grams, the comparable amounts of carbon deposited in seven hour test periods on test pieces employing five (5) glass-ceramics having compositions set forth in TABLE I; also, on an uncoated alloy sample and a fused quartz sample used as a standard. The sample numbers in TABLE III corresponds to the composition numbers in TABLE I.

TABLE III

| Sample | Weight (grams) |
|---|---|
| 10 | 0.0032 |
| 12 | 0.0005 |
| 4 | 0.0028 |
| 7 | 0.0016 |
| 14 | 0.000 |
| Uncoated | 0.0747 |
| Quartz | 0.000 |

It is readily apparent that the rate of coke formation on the test piece coatings was comparable to that on fused quartz, and a magnitude or less than that on uncoated metal.

Successful tests led to determining compatibility and effectiveness of glass-ceramic coatings with austenitic cast alloys of the type used in cracking furnace tubes. Such tubes are on the order of 10 cm (4") diameter and several meters in length. Accordingly, tests were made on coupons which were cut from lengths of commercial tubing and were 5 cm (2") in length and 1.2–2.5 cm (½–1") wide.

Test samples were cut from pipes of three commercial Fe—Cr—Ni alloys: HP-40, HP-45 and HK-40. These alloys contain a minor amount of carbon, indicated in hundredths of a percent by the numeral in the designation, as well as certain other minor alloy constituents.

For test purposes, a kilogram (2 pound) melt of each glass was made in a furnace operating at 1600° C. for four hours. Each melt was dri-gaged, that is, poured into water to quench the glass and cause it to fracture into particles. With subsequent larger melts, the molten glass was rolled to form a thin sheet which was then crushed.

To prepare a coating slurry, the broken glass was dry ball milled with alumina media for 8 hours in an alumina container. This reduced the glass to an 8 micron average particle size. Separately, a polybutyl methacrylate binder was mixed with equal parts of ethyl and amyl acetate to form a homogeneous vehicle.

The frit powder, in a ratio of 2.5 grams to 1 gram of binder, was added to the vehicle and rolled with zirconia balls in a plastic container to form a coating slip. Other known binders and vehicles may be employed, the materials and proportions selected being dependent on the coating operation. The coating slip was applied to the coupons by repeatedly dipping the sample in the coating and drying to provide a coating having a thickness of about 200 mg coating/6.5 sq. cm (1 sq. in.).

The coated coupons were then heated to cause the glass frit to soften and flow sufficiently to adhere to the metal. Further heating cerammed the glass, that is, converted it by thermal crystallization to a glass-ceramic. This involved heating the coated samples to 500° C.; holding one hour; heating to 1150° C.; cooling to 1050° C. at furnace rate; holding 4 hours; and cooling to ambient. During this cycle the samples were supported by refractory supports.

Alternatively, the glass can be crystallized (cerammed) by holding at the higher temperature without cooling, but this frequently produces a less desirable crystal pattern.

Adherence of the coating was tested by making a saw cut in the glass-ceramic coated coupon. This test is based on a finding that poorly adhering coatings quickly spall when subjected to a saw cut and then boiling water. The coatings tested were considered to show good adherence.

Service life was tested by thermal cycling. In this test, the coated sample was held for 110 minutes at 850° C. It was then removed from the heating chamber for 10 minutes. During this time, it dropped to a temperature well below red heat. After 24 cycles, the samples were cooled and a portion of the coating removed by partial masking and grit blasting. Then, the partially coated samples were subjected to another 24 cycles. No spalling of the coating occurred on any of the samples tested even after partial coating removal.

To further test endurance of the coating on a small scale, 15 cm (6") coupons were cut from commercial furnace tubing. The coupons were coated, heated to 850° C. and held at that temperature for several weeks in a steam atmosphere. Following this steam treatment, some changes in opacity of the coating were noted. However, the coating remained adherent to the metal and intact.

The effect of particle size of the glass frit was determined by preparing slurries with mean particle sizes of 5.92, 8.25, 18.62 and 26.21 microns. These slurries were applied to test pieces of HP-45 metal tubes and subjected to a ceramming cycle. One set was heated to a top temperature of 1150° C.; a second set was heated to a top temperature of 1200° C.

The coatings prepared with the two larger size particles were found inferior to the coatings produced with the smaller particle size material. Based on these tests, a coating material prepared with a glass frit having a mean particle size not over about 10 microns is preferred.

Tests conducted on coatings of varying thickness indicate that a fired glass-ceramic coating of 0.0375–0.250 mm (1.5–10 mils) thickness is preferable. With a lesser thickness, full coverage of the surface is not always obtained and thin spots tend to appear. With greater thicknesses, there is a tendency to spall on heat cycling.

Figure 2:
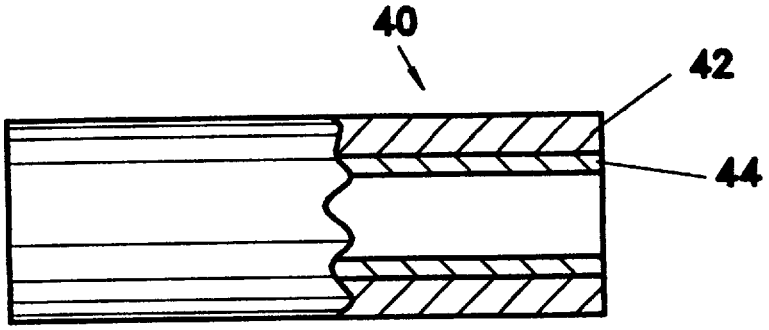

FIG. 2 is a front elevational view, partly broken away, of a segment 40 of a commercial reactor tube. Such a commercial tube may be up to 12 meters (40 ft.) in length and have a diameter of 2.5–20 cm (1"–8"). Segment 40 comprises a cast alloy tube 42 having a glass-ceramic coating 44 on its inner surface. It will be appreciated that a cracking furnace will comprise tubes and fittings, such as elbows, connecting adjacent lengths of tubing. It is contemplated that a complete cracking furnace, including tubes and fittings, will be coated in accordance with the invention. However, short lengths of tubing may be coated and joined, as by welding.

Figure 3:
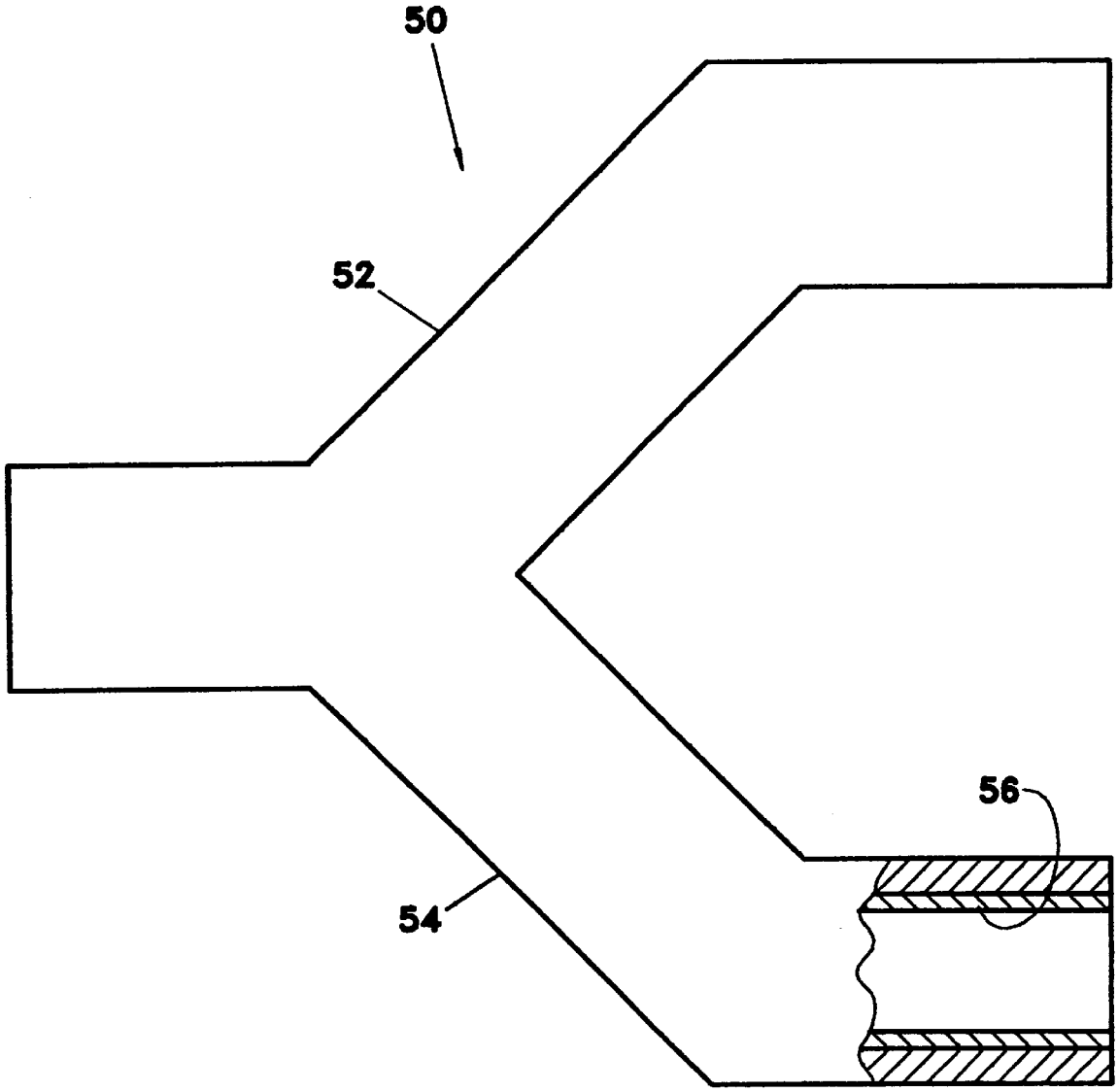
FIG. 3 is a front elevational view, partly broken away, showing a furnace fitting in accordance with the invention.

FIG. 3 is also a front elevational view partly broken away. It shows a typical fitting 50 designed to be installed between tube lengths. Fitting 50 is a branched tube adapted to receive a feed stream from the left hand side. It functions to split the stream into two roughly equal streams which enter branches 52 and 54.

The entire interior wall of fitting 50, including branches 52 and 54, may be coated with glass-ceramic coatings 56. This is illustrated in the cutaway portion of branch 54.

It is contemplated that all exposed interior surfaces in a pyrolitic furnace system, both within the firebox and outside, will be coated to lessen coking tendencies. As is well known in the industry, fittings include such diverse elements as branched tube connections, elbows, elbow inserts and transfer line exchanger plates.

I claim:

1. A furnace element for insertion in a furnace for thermally cracking or reforming hydrocarbons, the furnace element having a thin, adherent layer of a glass-ceramic material on at least a portion of the furnace element surface exposed to hydrocarbons to inhibit deposition of carbon.

2. A furnace element in accordance with claim 1 wherein the glass-ceramic layer is 0.0375–0.250 mm (1.5–10 mils) in thickness.

3. A furnance element in accordance with claim 1 wherein the element is composed of an austenitic metal and the glass-ceramic layer has a cristobalite crystal phase.

4. A furnace in accordance with claim 1 wherein the glass-ceramic layer contains a cystal phase selected from the group consisting of alkaline earth metal silicate, alkaline earth metal aluminoborosilicate and alkaline earth metal aluminoborate crystal phases.

5. A furnace in accordance with claim 4 wherein the glass-ceramic layer is a barium aluminosilicate or a strontium-nickel aluminosilicate glass-ceramic.

6. A furnace element in accordance with claim 5 wherein the glass-ceramic is a barium aluminosilicate that contains primary crystal phases of sanbornite and cristobalite and that consists of, in percent by weight on an oxide basis, 20–65% BaO, 25–65% $SiO_2$ and up to 15% $Al_2O_3$.

7. A furnace element in accordance with claim 5 wherein the glass-ceramic is a strontium-nickel aluminosilicate that contains primary crystal phases of $SrSiO_3$ and $Ni_2SiO_4$ and that consists essentially of, in weight percent on an oxide basis, 20–60% SrO, 30–70% $SiO_2$, up to 15% $Al_2O_3$ and up to 25% NiO.

8. A furnace element in accordance with claim 1 wherein the furnace element is a reactor tube having an interior wall and having a glass-ceramic coating on that interior wall.

9. A furnance elemnt with claim 1 wherein the furnace element is a flitting having a surface exposed to the hydrocarbons and having a glass-ceramic coating on at least a portion of the exposed surface of the fitting.

* * * * *